US005857221A

United States Patent [19]

Geneve et al.

[11] Patent Number: 5,857,221

[45] Date of Patent: Jan. 12, 1999

[54] SWIM GOGGLES WITH IMPROVED ADJUSTABLITY

[75] Inventors: Francois Geneve; Peter Langmar; Stephen Melamed, all of Chicago, Ill.

[73] Assignee: ERO Industries, Inc., Mt. Prospect, Ill.

[21] Appl. No.: 862,674

[22] Filed: May 23, 1997

[51] Int. Cl.[6] ..... A61F 9/02

[52] U.S. Cl. ..... 2/428; 2/445; 2/452

[58] Field of Search ..... 2/428, 430, 445, 2/426, 452; 351/43, 155, 156

[56] References Cited

U.S. PATENT DOCUMENTS

| | | | |
|---|---|---|---|
| 2,660,092 | 11/1953 | Bloom . | |
| 3,397,026 | 8/1968 | Spina . | |
| 4,881,803 | 11/1989 | Giles et al. . | |
| 4,953,967 | 9/1990 | Somerville . | |
| 4,974,956 | 12/1990 | Gill . | |
| 5,087,118 | 2/1992 | Gill . | |
| 5,208,950 | 5/1993 | Merritt . | |
| 5,313,671 | 5/1994 | Flory . | |
| 5,369,452 | 11/1994 | Williams . | |
| 5,390,373 | 2/1995 | Flory . | |
| 5,502,844 | 4/1996 | Alvarado | 2/445 |
| 5,541,676 | 7/1996 | Pallat . | |
| 5,706,526 | 1/1998 | Huang | 2/428 |
| 5,727,259 | 3/1998 | Kawamata | 2/452 |

*Primary Examiner*—Peter Nerbun
*Attorney, Agent, or Firm*—Lockwood, Alex, FitzGibbon & Cummings

[57] ABSTRACT

A pair of swim goggles for use during water activity, such as swimming. A pair of eyecups are worn by the user and held in place by a pair of elastic cords that encircle the user's head. The cords connect the eyecups together and a nose bridge therebetween. The cords are received within track portions on opposing sides of a centerline the eyecups and held in position by a plastic retainer. The cords are further positioned about the user's head and secured into position by a toggle lock engageable with the cords on the back of the user's head.

19 Claims, 2 Drawing Sheets

FIG. 3
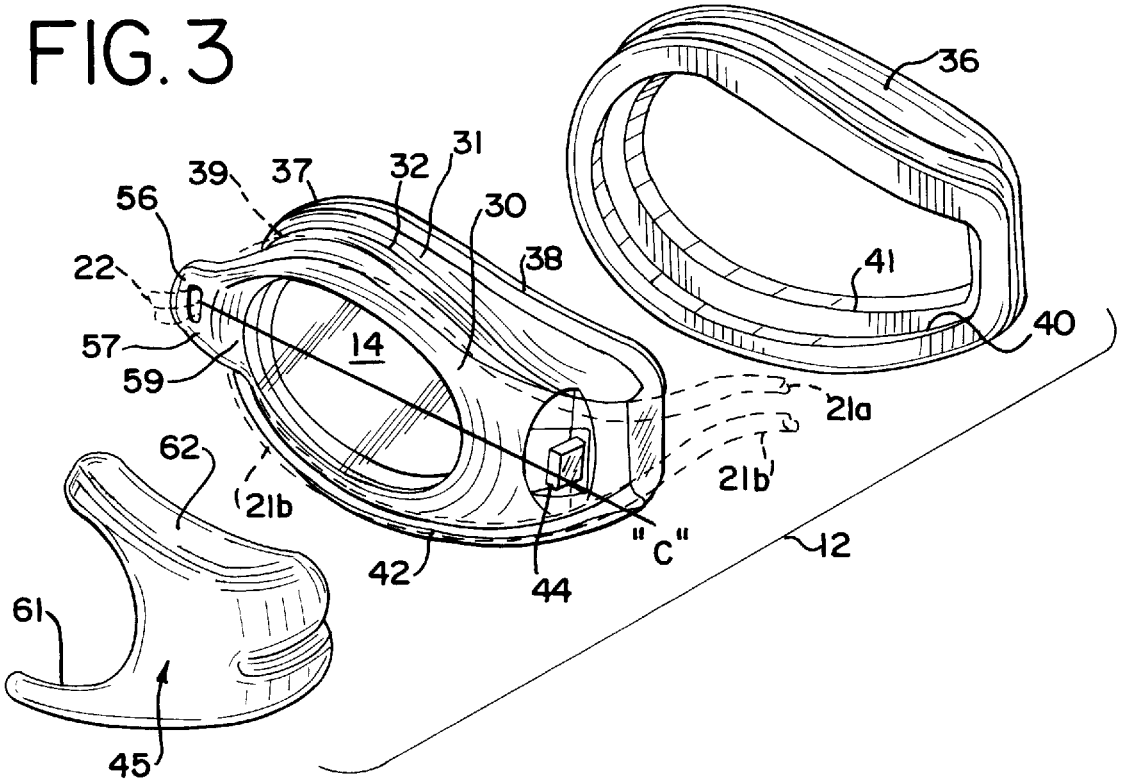
FIG. 4
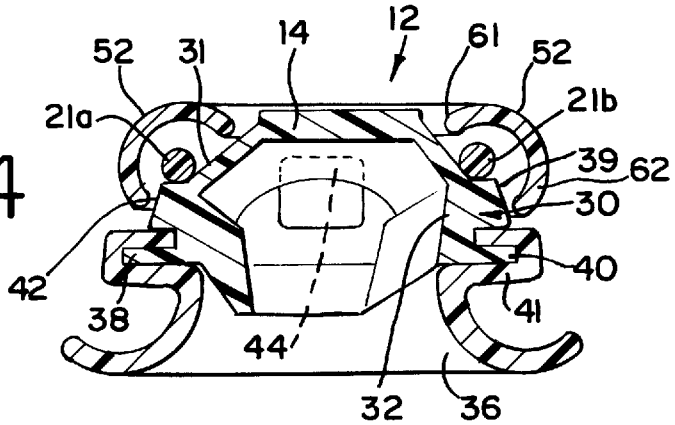
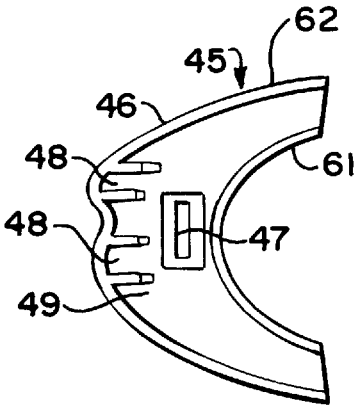
FIG. 5

SWIM GOGGLES WITH IMPROVED ADJUSTABLITY

BACKGROUND OF THE INVENTION

The present invention relates generally to swimming goggles used to protect the eyes during both leisure and competitive swimming activities. More particularly, the present invention relates to swim goggles worn during swimming that shield the eyes of a user from the water and which have improved adjustability.

Swim goggles have become popular in the mass market both for their protective capabilities, as they shield the user's eyes from water and chemicals therein as well as for their ability to permit the user the opportunity to wear corrective lenses while swimming. Swim goggles provide a sport user with the confidence to compete without the fear of injury or displacement to corrective contact lenses and the recreational user with the ability to reliably shield the user's eyes from the water. Swim goggles currently on the market provide a significant degree of comfort essential to a competitive swimmer but most such goggles are difficult to adjust while wearing them. Therefore, a need exists for a pair of swim goggles in which the user can precisely adjust the goggles with little effort and whereby there is provided a very comfortable custom fit about the head and nose.

Accordingly, the present invention is directed to an improved pair of sport goggles which provide for protective capabilities through a superior comfort fit by utilizing a head strap comprised of flexible double cords that extend around the eyecups in order to interconnect the goggle eyecups and also to serve as an adjustable nose bridge. Although the invention may be best typified by describing its use in connection with competitive swim goggles, by no means are the goggles of the present invention limited to that particular application.

Swim goggles that use tubing as a head strap are well known in the art. For example, U.S. Pat. No. 5,390,373, issued Feb. 21, 1995, describes swim goggles that have two eyecups interconnected by a piece of resilient tubing that forms a nose bridge for the goggles. The goggles are held upon the head of the wearer by a single piece of tubing that forms a head strap. Both pieces of tubing are secured to the eyecups by inserting posts formed on the eyecups into holes formed in the ends of the tubing. This arrangement is subject to slippage and adjustment of both the nose bridge and head strap is time-consuming in that the goggles must typically be removed from the user to adjust them. The tubing may also come free from the posts.

U.S. Pat. No. 5,541,676, issued Jul. 30, 1996, describes a flexible headband for eyeglasses that uses a flexible rubber cord that has an adjustable clamp that the cord passes through for adjusting the headband. In this arrangement, the cord is attached to existing portions of eyeglasses and secures the eyeglasses around the head. Although the eyeglass frames are positioned securely on the user, such a structure is uncomfortable for the user as the nosepiece of the rigid frame is biased against his face.

U.S. Pat. No. 4,953,967, issued Sep. 4, 1990, describes a pair of sport eyeglasses that uses an adjustable flexible band to secure the eyeglasses to the user's head. The band includes a loop that binds the band together and provides a means for adjusting the fit of the eyeglasses on a user. This method of securement is also subject to slippage, but more importantly this design lacks stability and during vigorous sporting activities is prone to an amount of undesirable displacement and even dislodgement.

In view of the aforementioned need and the shortcomings of the prior art, it is therefore an object of the present invention to provide a pair of goggles which overcomes the disadvantages of the prior art and which can be precisely adjusted with little effort and whereby there is provided a "custom" fit to the user.

Another object of the present invention is to provide a pair of goggles that utilize a doubled stretchable cord for as a head strap, the cord looping through a pair of eyepieces and interconnecting the eyepieces together while forming a nose bridge, such that the head strap adjusts both the fit of the goggle around the user's head and nose.

Still another object of the present invention is to provide an eyecup structure for a set of goggles that maintains stability and comfort while the wearer is engaged in strenuous activity and retains a head strap that interconnects the eyecups together in place on the user.

Yet another object of the present invention is to provide a pair of sport goggles that can be quickly and precisely adjusted while being worn and whereby such adjustment is nearly automatic.

These and other object, features and advantages of the present invention will be clearly understood through a consideration of the following detailed description.

SUMMARY OF THE INVENTION

The present invention satisfies these objects and offers these beneficial advantages over prior art goggles by providing a pair of goggles having two eyecups with rigid lens portions and resilient seal portions that partially mold to the contour of a user's face. A head strap in the form of a pair of elastic cords interconnects the eyecups at opposing ends to provide an integral adjustable head strap-nose bridge assembly so that the adjustability of the goggles is facilitated while in place upon the user.

In order to properly position the cords on the eyecups and to facilitate the ease of adjustability of the swim goggles, the eyecups, as exemplified in the preferred embodiment, include guide portions that serve to guide the cords around the eyecup lens portions between opposing ends of eyecups to the nose bridge. A retainer is provided for engagement with each eyecup and cooperates with the eyecups to form the cord guide portions.

The eyecups include tracks in the form of channels that approximately surround the lens portions and extend between opposing sides of the eyecups. The retainers preferably take the form of cowlings that cover portions of the eyecups. The cowlings have cord-receiving channels formed therein that oppose the eyecup guide portions, so that when the cowlings are in place upon the eyecups, the cords are retained in place between them.

The eyecups each include a fork portion that extends outwardly from and above the lens portion, the fork portions including openings that receive the cords therethrough to form the nose bridge of the goggles. Inasmuch as two cords extend completely around the eyecups and nose bridge, the cords form a head strap that is easily adjustable by the user and does not necessitate removal of the goggles from the user's head in order to adjust them.

These and other objects, features and advantages of the present invention will be clearly understood through consideration of the following detailed description.

BRIEF DESCRIPTION OF THE DRAWINGS

In the course of the following detailed description, reference will be frequently made to the accompanying drawings in which:

FIG. 3 is an exploded view of an eyecup used in the goggles of the present invention;

FIG. 4 is a cross-sectional view of one of the goggles of FIG. 1 taken along lines 4—4 thereof; and, FIG. 5 is a plan view of a retainer used on the eyecups of the swim goggles of FIG. 1, illustrating the inner surface thereof.

DESCRIPTION OF THE PREFERRED EMBODIMENT

Figure 1:
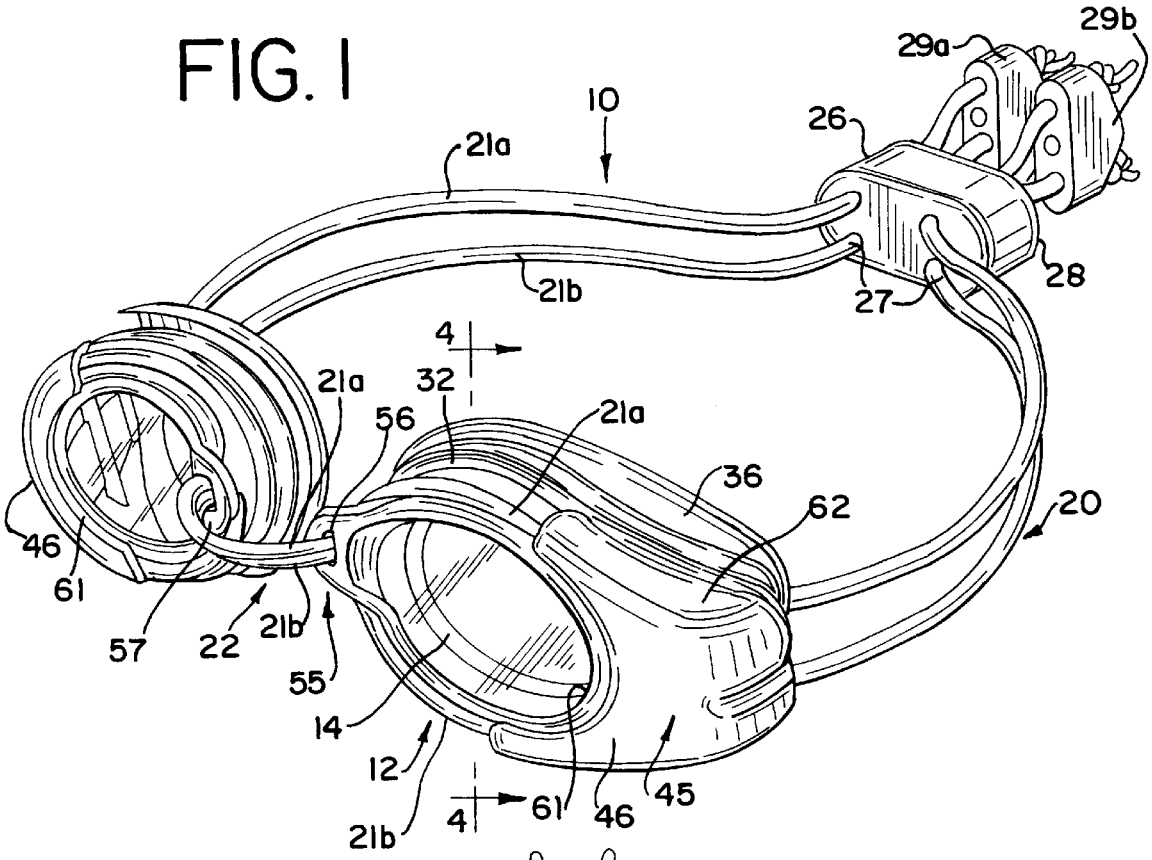
FIG. 1 is a perspective view of a pair of goggles constructed in accordance with the principles of the present invention.
Figure 2:
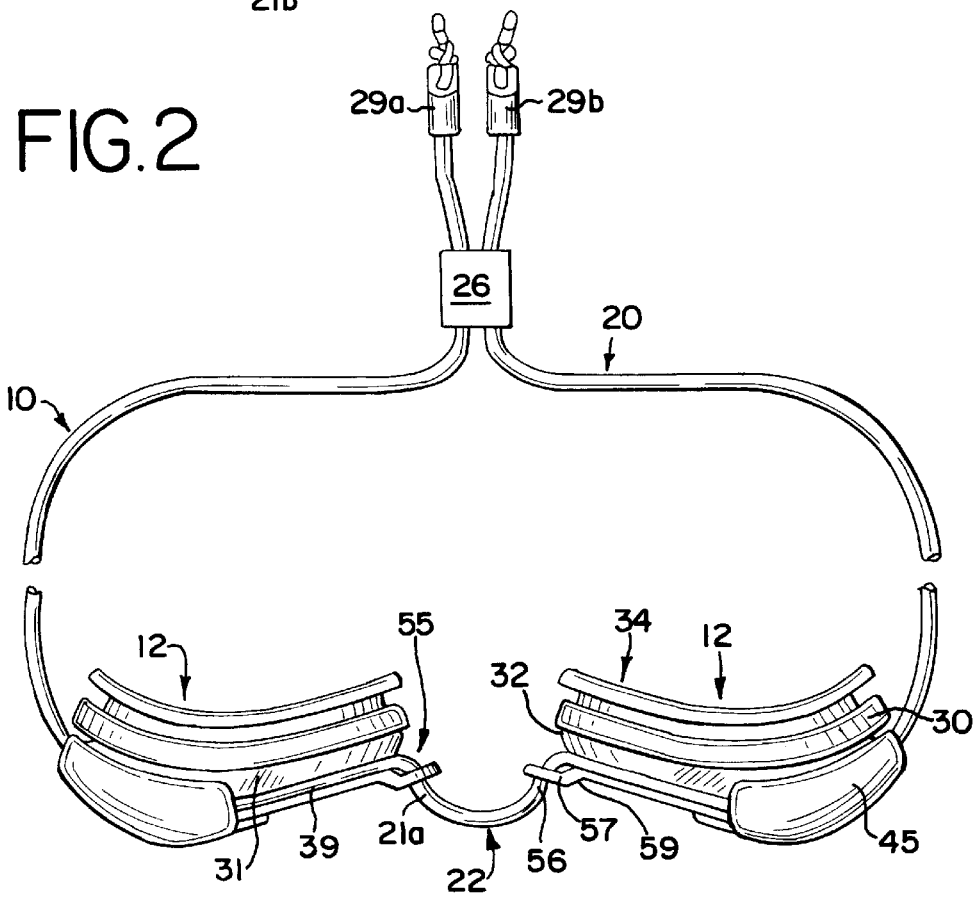
FIG. 2 is a top plan view of the goggles of FIG. 1.

FIG. 1 illustrates a pair of goggles 10 constructed in accordance with the principles of the present invention and suitable for recreational or competitive use. The goggles 10 include a pair of eyecups 12 with distinct lens portions 14. The eyecups 12 are each contoured to fit to a user's face shield the eyes of a user from water and are interconnected together by a head strap 20 shown in the drawings as a pair of elastic cords 21*a*, 21*b*. These cords 21*a*, 21*b* are preferably made form a flexible and stretchable material, such as rubber, neoprene, latex or the like.

The cords 21*a*, 21*b* pass around the eyecups 12 and interconnect them together at a nose bridge 22 located between the eyecups 12. The cords 21*a*, 21*b* may be solid in cross-section as illustrated or alternatively, the cords 21*a*, 21*b* may be hollow and formed of a hollow flexible tubing. The cords 20*a*, 20*b* may include and pass through a toggle lock assembly 26 that comprises a plurality of openings 27 that the cords 21*a*, 21*b* pass through and a frictional contact member 28 that applies a frictional force to the cords 21*a*, 21*b* in a manner known in the art. Stops 29*a*, 29*b* may be applied to the cords 21*a*, 21*b* near their free ends outboard of the toggle lock assembly 26.

As seen best in FIG. 3, each eyecup 12 includes a flat lens portion 14 supported on a hollow base 30 that encircles the lens portions 14 in a manner such that the base 30 forms a continuous "sidewall" 32 of the eyecup base 30. This sidewall 32 forms an interior pocket 34 in which air is trapped to permit the user to open his/her eyes without contacting the water. Although the eyecup base 30 is generally contoured to fit a user's face, a flexible skirt 36 is provided around the perimeter 37 of the eyecup base 30 and is held in place thereon by engaging a lip 38 that extends around the base perimeter 37. The eyecups may be formed from a durable material such as polycarbonate, polyvinylchloride or other suitable clear plastic.

The skirt 37 is preferably formed from a flexible compound such as rubber, latex or the like and has an interior channel 40 and rim 41 formed therein that cooperatively engage the lip 38 of the eyecup base perimeter 37. The exterior surfaces 31 of the eyecup bases 30 preferably include one or more guide portions 39 that direct the head strap cords 21*a*, 21*b* around the lens portions 14 of the eyecups 12. The guide portions 39 may take the form of raised shoulders 42 that extend between opposing sides of the eyecups 12 and, in essence, form distinct first and second tracks which receive the cords 21*a*, 21*b*. The cords 21*a*, 21*b* are spaced apart from each other from the point they first enter the eyecups until they meet below the flanged portion 57 near the nose bridge 22. The cords 21*a*, 21*b* may be considered as being disposed on opposite sides of a centerline C of the lens portions 14. (FIG. 3.)

In order to assist the eyecup guide portions 39 in directing the cords 21*a*, 21*b* on the eyecups 12 and to retain the cords 21*a*, 21*b* in place around the eyecup lens portions 14, the eyecups 12 each include a retainer 45. The retainer 45, as illustrated best in FIGS. 3 and 5, takes the form of a cowling 46 and includes an interior slot 47 that engages an opposing engagement post 44 projecting from the eyecup base 30. In order to provide the requisite measure of separation between the two cords 21*a*, 21*b* where they enter the eyecup bases 12, and in order to assist in directing the cords 21*a*, 21*b* in place on the eyecups 12 in the guide portions 39, the retainer cowling 46 preferably includes channels 48 that receive the cords 21*a*, 21*b* therein.

The retainer channels 48 are defined by walls 49 formed on the interior surfaces 50 of the retainer cowlings 46. The channel walls 49 of the retainer 45 are preferably disposed thereon in opposition to the eyecup exterior surfaces 31 in order for the retainer channels 48 to cooperate with the eyecup guide portions 39 and guide and separate the cords 21*a*, 21*b*. Each cowling 46 further includes an inner rim 61 and an outer rim 62 interconnected by a body portion 52. The rims 61, 62 define in part, the edges of the cowling 46. The inner rim 61, as best seen in FIG. 3 lies proximate to the lens portion 14 of its associated eyecup, while the outer rim 62 lies proximate to the eyecup base 30 and its associated flexible skirt 36. The cords 21*a*, 21*b* are retained in place in the eyecup guide portions 39 by the cowlings 46 between the inner rim 61 and outer rim 62 thereof. As seen in FIG. 4, the outer walls 52 of the cowling 45 cooperate with the eyecup base shoulder 42 to retain the cords 21*a*, 21*b* in place around the lens portions 14.

A portion 54 of the eyecup base 30 rises up from the guide shoulders 42 and lens portions 14 to form a flanged fork 55 that projects upwardly and outwardly away from the lens portions 14. The fork 55 includes an opening 56 in its flange body 57 that receives the cords 21*a*, 21*b*. The flange body 57 is preferably flat and extends approximately parallel to the plane of the lens portions 14. The fork flange body 57 has a leg 59 that elevates it with respect to the lens portion 14. The flange leg 59, as best illustrated in FIG. 1, offsets the cord opening 56 of the fork flange 57 and cooperates with the retainer cowling 46 to retain the cords 21*a*, 21*b* in place around the eyecup lens portions 14.

It can be seen from the Figures that the eyecup guide portions 39 maintain the two cords 21*a*, 21*b* in a proper position for a comfortable fit on a user's head. Because the head strap cords 21*a*, 21*b* are continuous in their extent around the eyecups 12, underneath the retainer portions 45 and through the flanged portions 57, a user may pull on the cords 21*a*, 21*b* and adjust the head strap 20 and the nose bridge 22 simultaneously, thereby providing the goggles 10 with a novel stability and comfort upon the user's face. This is in contrast to conventional swim goggles that typically use a single elastic band that is attached to common sides of the eyecups as a nose bridge. Such a structure tends to create a disproportionate amount of force at the point of attachment and makes the goggles uncomfortable to wear for an extended period of time. Additionally, the double cords 21*a*, 21*b* extending completely around the eyecups 12 enable the user to keep a minimal amount of tension on the head strap 20 while still providing enough force to bias the flexible portion 18 against the user's face for the goggles 10 to remain secure and to provide an airtight seal between the goggle eyecups 12 and the user's face.

The elastic cords 21*a*, 21*b* and toggle lock assembly 26 allow for easy adjustment of the goggles 10 to achieve a tight fit. By providing a single locking mechanism by way of the toggle assembly 26 at a point on the head strap 24 that is equidistant from both the distal ends of the eyecups 12, the lateral force exerted by the head strap 20 will pull the eyecups 12 against the face will be equivalent at both eye sockets. The elastic cords 21*a*, 21*b* used for the nose bridge 22 provides a further "custom" fit with no further special adjustment needed. This adjustment is precise and quick as it can be adjusted while being worn either by an adult for a child, or by the user himself.

While the preferred embodiment of the invention has been shown and described, it will be apparent to those skilled in the art that changes and modifications may be made therein without departing from the spirit of the invention, the scope of which is defined by the appended claims.

We claim:

1. A pair of swim goggles, comprising: a pair of eyecups, each eyecup having a housing with a base portion adapted to contact a user's head and fit over the user's eyes, a distinct lens portion, a flange portion extending from said eyecup housing base portion toward a user's nose and, a retainer engageable with said eyecup housing, the swim goggles further including a head strap for securing said goggles to said user's head, the head strap including a pair of elongated, resilient members interconnecting said two eyecups together at their respective flange portions to form a resilient nose bridge of said goggles, said head strap cords extending around said eyecups on opposite sides of said eyecup lens portions and through said eyecup flange portions, said retainers including respective inner and outer rim portions that overlie said head strap members such that said retainers retain portions of said head strap members in place on an associated eyecup housing between said retainer inner and outer rim portions to thereby retain said head strap members in place upon said eyecups between said eyecup housings and said retainers, said head strap resilient members each having two loose ends that are secured together by a securement assembly.

2. The swim goggles of claim 1, wherein said two head strap members each include opposing free ends and said securement assembly includes a toggle lock mechanism interconnecting said head strap member free ends together.

3. The swim goggles of claim 1, wherein each of said eyecup flange portions includes an opening through which said head strap members pass.

4. The swim goggles of claim 3, wherein said head strap resilient members include cords formed from an elastic material.

5. The swim goggles of claim 1, wherein said eyecups each include guide portions extending around said eyecups on opposite sides of a centerline of said eyecup lens portions.

6. The swim goggles of claim 1, wherein each of said retainers includes a cowling.

7. The swim goggles of claim 6, wherein each of said cowlings include a guide surface disposed between said inner and outer portions.

8. The swim goggles of claim 6, wherein each of said cowlings includes a recess formed within an interior surface thereof, and each of said eyecup housings includes a projection that is received within a corresponding cowling recess in order to hold said cowling in place upon said eyecup housing.

9. The swim goggles of claim 5, wherein each of said eyecup flange portions includes an opening through which said head strap members pass, said eyecup flange portions being aligned with said guide portions such that said guide portions at least partially direct said head strap members toward said flange member openings.

10. The swim goggles of claim 5, wherein said eyecup housing guide portions include shoulder portions formed on said eyecup housings, the shoulder portions being spaced apart from said lens portions.

11. The swim goggles of claim 10, wherein said retainer inner rim portions are disposed proximate to said lens portions and said retainer outer portions are disposed proximate to said eyecup housing base portions when said retainers are in place upon said eyecup housings, said head strap members being retained in said eyecup housing guide portions by said retainers between said inner and outer rim portions thereof.

12. The swim goggles of claim 1, further including a flexible skirt extending around each eyecup housing base portion.

13. In a pair of swim goggles having two eyecup members, each eyecup member having a housing portion adapted to engage a user's face and fit over the eyes of the user, the housing portions having distinct lens portions through which said user can see when submerged in water, the improvement comprising: a head strap for attaching said goggles to said user's face, the head strap including a pair of elongated, stretchable head strap members having loose ends secured together by a securement element, each of said eyecup members having a flanged portion for engaging said head strap, the flanged portion being disposed on said eyecup member in proximity to said eyecup lens portion, the head strap members extending from said securement member across said eyecup members on opposite sides of said lens portions and into engagement with said flanged portions to thereby interconnect said eyecups together and to form a stretchable nose bridge segment of said goggles, said nose bridge segment being an integral part of said head strap members, each of said eyecup members further including guide portions disposed thereon for directing said head strap members around said lens portions and each of said eyecup members further including a retainer portion associated therewith overlying a portion of said associated eyecup member and extending partially around said eyecup member lens portion, said retainer portion also partially overlying said head strap members to thereby retain said head strap members in place on said eyecup member between said eyecup member and said retainer portion.

14. The improved swim goggles of claim 13, wherein said eyecup members include guide portions disposed thereon, the eyecup member guide portions directing said head strap members around said lens portions.

15. The improved swim goggles of claim 14, wherein said flanged portions include openings aligned with said eyecup member guide portions, said head strap members passing through said flanged portion openings after extending around said opposite sides of said eyecup member lens portions.

16. The improved swim goggles of claim 13, wherein said retainers detachably engage said eyecup members.

17. A pair of swim goggles, comprising: a pair of eyecups adapted to fit on a user's face over the eyes of said user, each eyecup having a lens portion, said eyecups further having first and second track portions disposed on opposite sides of a centerline of said eyecups, a head strap for securing said eyecups to said user's face, the head strap interconnecting said eyecups together, said head strap including first and second elongated, stretchable cords, the first cord being positioned within said eyecup first track portion and the second cord being positioned within said eyecup second track portions, each of said eyecups further including a retainer disposed thereon above said first and second track portions thereof, said retainer retaining said first and second cords in place within said first and second track portions of said eyecups in a spaced-apart relationship, said first and second cords defining a common, adjustable nose bridge segment of said head strap, said nose bridge segment being continuous with said head strap first and second cords.

18. The swim goggles as claimed in claim 17, further including a toggle lock assembly that slidably engages said first and second cords, and wherein said first and second cords have respective loose ends that are interconnected by said toggle lock assembly.

19. The swim goggles as claimed in claim 17, wherein said eyecups further include a flanged portion disposed proximate to said head strap nose bridge segment, said flanged portions each having a passage generally aligned with said first and second track portions, the first and second cords passing through said flanged portion passages to interconnect said eyecups together.

* * * * *